US005771957A

United States Patent [19]

Von Wyl et al.

[11] Patent Number: 5,771,957

[45] Date of Patent: Jun. 30, 1998

[54] DEVICE FOR THE CONTINUOUS CASTING OF STEEL

[75] Inventors: Horst Von Wyl, Duisburg; Hans-Joachim Paris, Düsseldorf; Hans Siemer, Essen; Jens Weber, Duisburg; Gerhard Böcher, Salzgitter; Otto Alexander Schmidt, Krefeld, all of Germany

[73] Assignee: Mannesmann Aktiengesellschaft, Düsseldorf, Germany

[21] Appl. No.: 564,169

[22] PCT Filed: Nov. 25, 1994

[86] PCT No.: PCT/DE94/01432

§ 371 Date: Feb. 7, 1996

§ 102(e) Date: Feb. 7, 1996

[87] PCT Pub. No.: WO95/15232

PCT Pub. Date: Jun. 8, 1995

[30] Foreign Application Priority Data

Dec. 3, 1993 [DE] Germany ..... 43 41 719.1

[51] Int. Cl.[6] ..... B22D 11/04

[52] U.S. Cl. ..... 164/416; 164/478

[58] Field of Search ..... 164/416, 478, 164/154.1

[56] References Cited

U.S. PATENT DOCUMENTS 5,202,134 4/1993 Moellers et al. ..... 164/416
5,350,005 9/1994 Sorimani et al. ..... 164/154.1

FOREIGN PATENT DOCUMENTS 3-151140 6/1991 Japan ..... 164/416

*Primary Examiner*—Joseph J. Hail, III
*Assistant Examiner*—I.-H. Lin
*Attorney, Agent, or Firm*—Cohen, Pontani, Lieberman & Pavane

[57] ABSTRACT

A device for the continuous casting of steel, consisting of a continuous casting mold which oscillates in the casting direction, is mounted on springs clamped at both ends which extend transverse to the direction of casting, and is connected with a hydraulic oscillation drive. The the hydraulic oscillation drives are servo-hydraulic cylinders, arranged in a longitudinal sectional plane placed through the continuous casting mold laterally alongside the continuous casting mold, the servo-hydraulic cylinders are firmly connected, free of play, to a support frame and with the continuous casting mold.

6 Claims, 3 Drawing Sheets

DEVICE FOR THE CONTINUOUS CASTING OF STEEL

CROSS-REFERENCE TO RELATED APPLICATION

This application is A 371 of PCT/DE94/01432, filed Nov. 25, 1994.

BACKGROUND OF THE INVENTION

1. Field of the Invention

The present invention relates to a device for the continuous casting of steel.

2. Discussion of the Prior Art

Such a device is known from DE OS 22 48 066. That device consists of a continuous casting mold developed as an ingot mold so that, in particular in the case of slab molds, no adjustment in the width of the slab is possible. As a result, storage is very expensive since a special mold is necessary for each form of slab. Furthermore, the springs which support the mold and the drive units for the oscillation must be dimensioned very large since the entire mold, and therefore the actual shaping walls including the cooling system, must be supported and moved.

From EP 0 468 607 A1 it is already known to separate the shaping walls from the cooled holding frame so as to relieve the drive and to have spring elements which are dimensioned to be as small as possible.

On the other hand, a controlled hydraulic drive system for continuous casting molds is known from DE 35 43 790 C2 with which twist-free guidance of the mold with respect to the cast billet is striven for.

SUMMARY OF THE INVENTION

The object of the present invention is to achieve a further simplification and improvement of the oscillation of the mold.

Pursuant to this object, the inventive device includes a support frame and springs which are fixed to the support frame at their ends so that the springs are transverse to the casting direction of the device. A continuous casting mold is mounted on the spring so as to oscillate in the casting direction and oscillating drive means are connected to the support frame for oscillating the continuous casting mold. The oscillation drive means includes servo-hydraulic cylinders fixed to the support frame in a longitudinal sectional plane which passes through the continuous casting mold laterally adjacent the continuous casting mold so that the cylinder is free of play. Furthermore, the continuous casting mold is fastened to the springs at a single point or location.

Pursuant to a further embodiment of the invention, the continuous casting mold is an arc-type mold having a curved longitudinal axis. The springs are arranged in a region of a top edge and a bottom edge of the continuous casting mold and are aligned in a lengthwise direction on a straight line which passes through a center of curvature of the longitudinal axis of the mold, parallel to a longitudinal sectional plane of the mold.

Still another embodiment of the invention has the single point at which the continuous casting mold is fastened to the springs displaced from a center point between the frame-side intersection points of the springs towards a center of curvature of the curved longitudinal axis. The servo-hydraulic cylinders have piston rods that are fastened to a lower edge of the mold in a stroke direction of the piston rods.

In yet another embodiment of the invention the piston rod has an upper end that is fastened to the springs, which upper end is configured as a spring element.

A further embodiment of the invention has the continuous casting mold formed by wide-side plates and narrow-side plates that are clamped between the wide-side plates. The narrow-side plates are fastened to fastening blocks and the servo-hydraulic cylinders are connected to the support frame by a bracket. The spring element of the piston rod is fastened to the bottom side of the fastening blocks to which the narrow-side plates are fastened.

In still another embodiment, means are provided for clamping the springs to the top and bottom sides of the fastening blocks. The ends of the springs are held in clamping blocks which are mounted on the support frame and the clamping blocks are mounted to fastening supports that arranged on the support frame reference to the drawings, which show the principle of the invention.

DETAILED DESCRIPTION OF THE PREFERRED EMBODIMENTS

Figure 1:
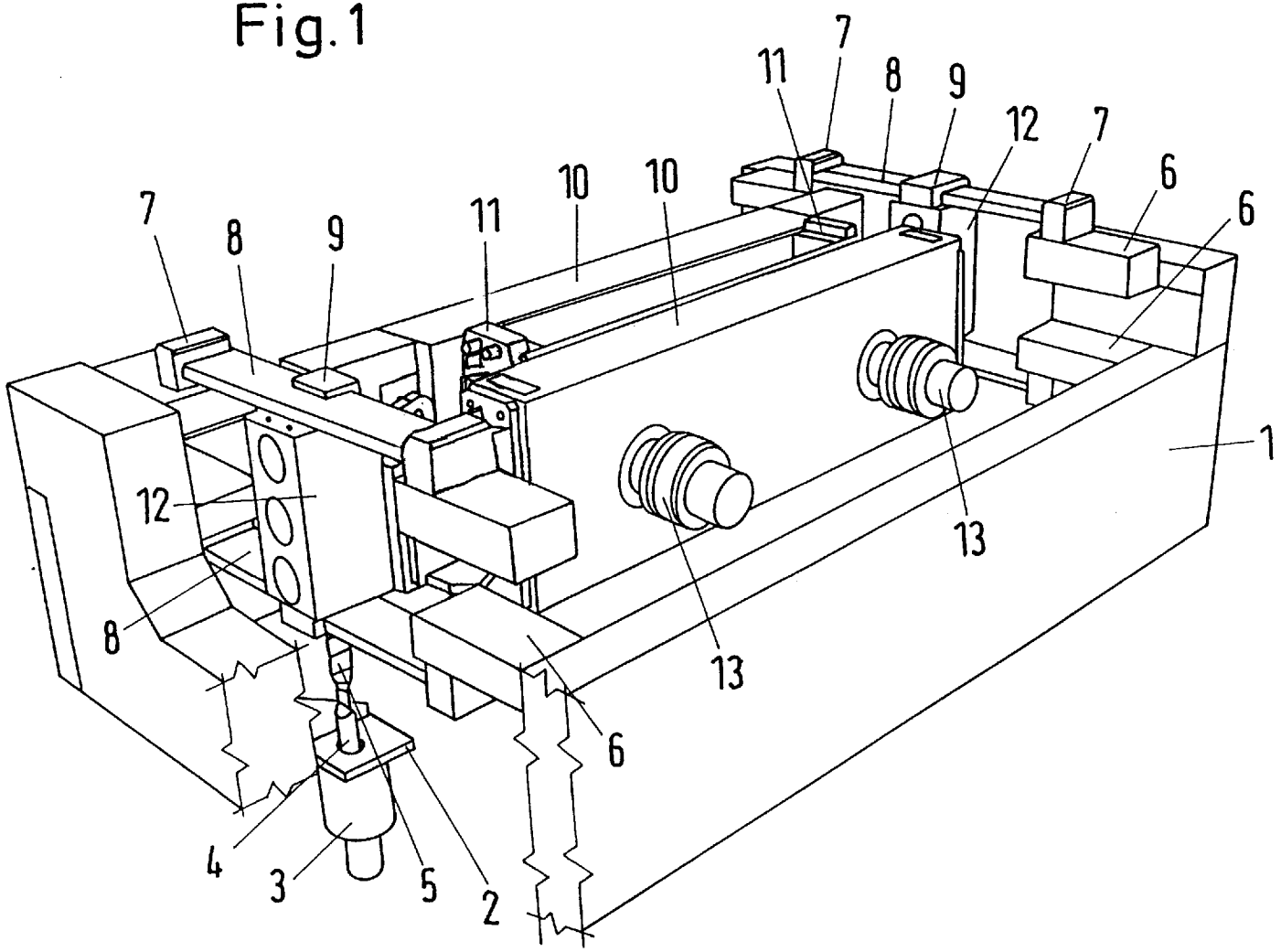
FIG. 1 is a perspective view of a device for continuous casting of steel pursuant to the present invention.
Figure 2:
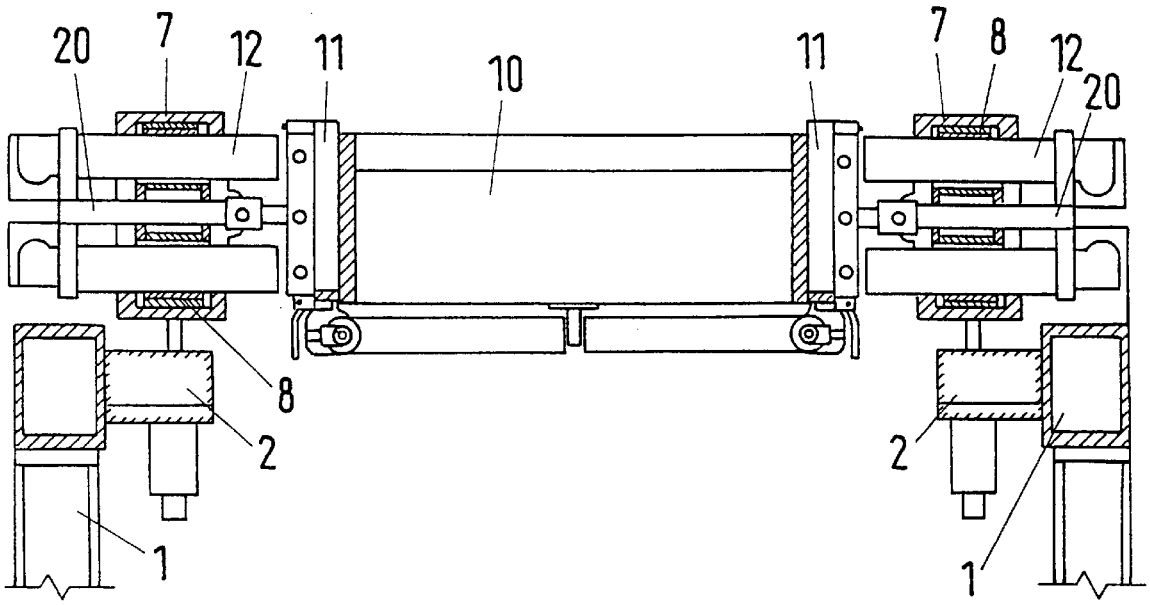
FIG. 2 is a longitudinal section through inventive the device.
Figure 3:
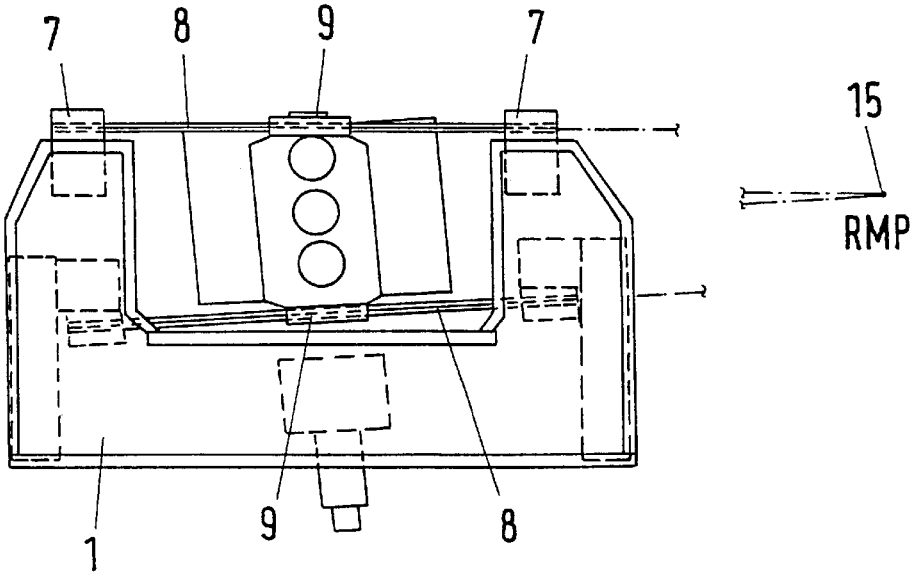
FIG. 3 is an end view of the device of FIG. 1.

FIGS. 1 to 3 show a support frame 1 for a continuous casting mold consisting of wide-side plates 10 and narrow-side plates 11. Compensators 13 are provided to compensate for cooling of the wide-side plates. The narrow-side plates 11 are held in position between the wide-side plates 10 by not illustrated clamping devices. The narrow-side plates 11; are fastened to a fastening block 12 for water boxes and narrow-side adjustment devices 20 for adjustment of the width of the mold. The fastening block 12 is connected with springs 8 via clamping means 9. The springs 8 extend above and below the fastening block 12 and are fastened in each case at their free ends in clamping blocks 7. The clamping blocks 7 are arranged on fastening supports 6 which are a part of the support frame 1. Hydraulic cylinders 3 with their piston rods 4 are fastened below the fastening blocks 12. The hydraulic cylinders 3 are fixed in position by brackets 2 of the support frame. The upper end of the piston rods 4 which act on the fastening blocks 12 is configured as spring element 5 so that, in the case of molds having a curved longitudinal axis and accordingly an oscillatory movement of the mold on an arc and a tangential movement of the piston rod 4, deflections of the point of attack of the piston rod 4 due to the arcuate movement of the mold are taken up by the spring elements 5 and thus the functionality of the hydraulic cylinder 3 is not impaired. The piston rod 4, which is constructed as a spring element 5, imparts oscillatory movement directly to the mode due to actuation of the piston rod 4 within the hydraulic cylinder 3.

Figure 4:
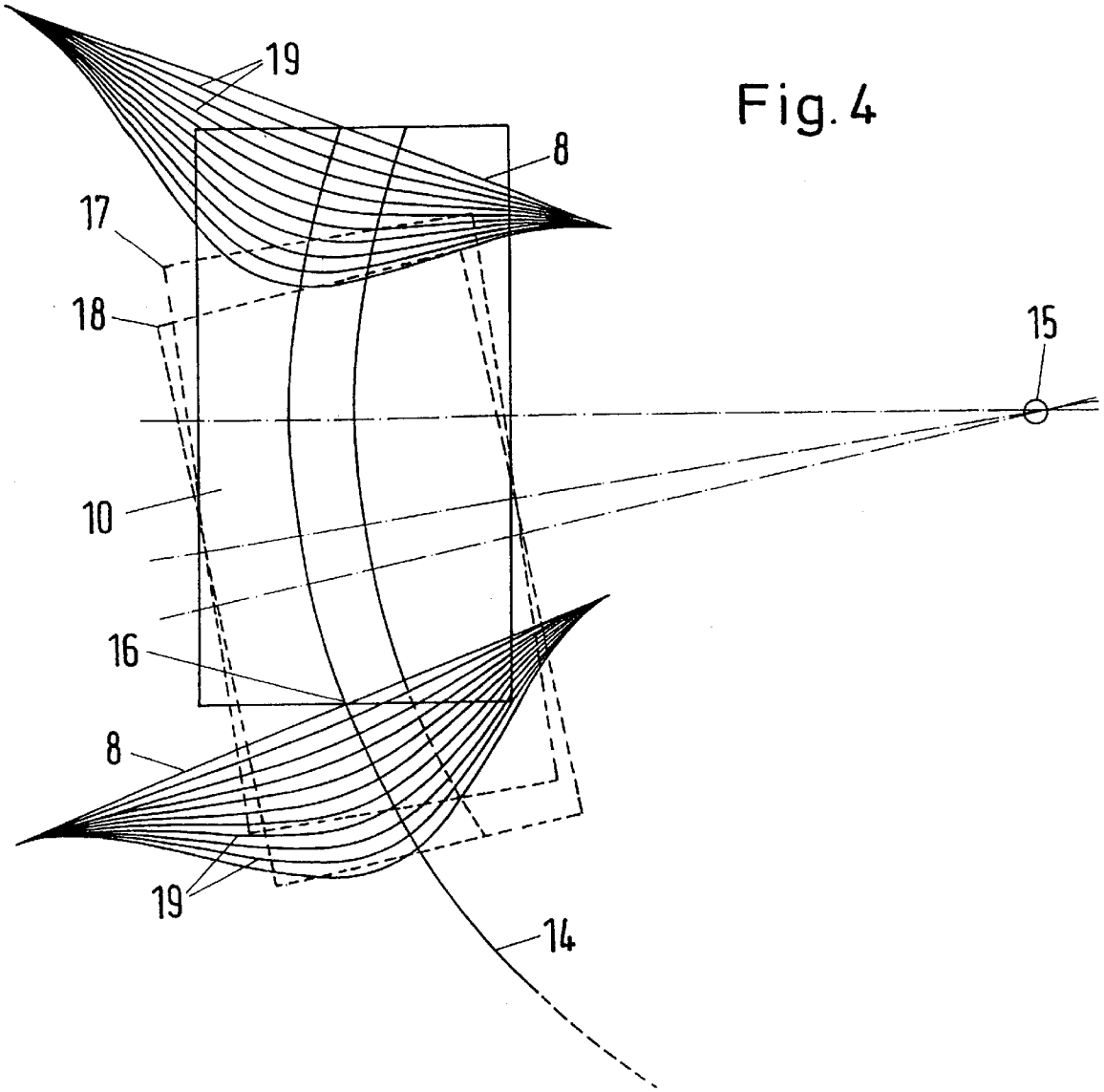
FIG. 4 is a sketch of the kinematics of the device of the invention.

As shown in FIGS. 3 and 4, FIG. 4 being on a distorted scale for batter clarity, the upper and lower springs 8 are inclined relative to each other so that their vanishing lines intersect in a straight line drawn through the center of curvature 15 of the mold or of the longitudinal axis of the mold. It is clear, in particular from FIG. 4, that the fastening block 12 is pivoted to the springs 8 by the clamping means 9 not in the middle between the clamping blocks 7 of a spring but somewhat eccentric to the center of curvature 15. In FIG. 4, the curved longitudinal sectional plane 14 is placed in the arc-outer mold wide side 10, which therefore corresponds at the same time to the arc-outer rear edge of the ingot and to the application reference plane. The point of intersection 16 of the lower springs 8 with the longitudinal sectional plane 14 is therefore the point of attachment of the piston rod 4 to the mold. The solid lines represent the position of the mold in the mounting position. After the mounting, there is a static sagging of the mold and/or the springs, this position not being shown in the sketch. However, it lies between the "operating positions" of the mold (dashed lines), the position of the mold at the upper dead center of an oscillation stroke being designated by 17 and the lower point of reversal being designated by 18.

It is therefore clear that, the above case concerns a device in which the strength of the spring is adapted to the weight of the mold so that the device oscillates in the resonance region. Such so-called resonance molds therefore oscillate, due to their construction, around the position of their statistical sag. In this connection, the mold-side points of intersection move approximately on straight lines which form tangents to the casting arcs at the point of intersection with the spring axes. The guidance errors produced thereby, particularly in the case of central pivoting of the mold to the springs, increases with increasing static sag, larger stroke amplitudes, and decreasing casting radius. In accordance with the solution shown in FIG. 4, which at the same time represents the preferred embodiment for minimizing this "guidance error", the result is obtained by the above-described displacement of the point of intersection 16 to the curvature center point 15, that a resultant movement of the point of intersection gives a path curve which is practically identical to the casting radius.

Although the invention described already leads to excellent surface qualities of the casting, in particular by reduction of the depth of the so-called stoke marks, this improved surface is obtained, in the preferred embodiment also in plants which are operated with small casting radii, large strokes, and high frequency of the oscillation.

We claim:

1. A device for continuous casting of steel in a casting direction, comprising:

a support frame;

springs having ends fixed to the support frame so that the springs are transverse to the casting direction;

a continuous casting mold mounted on the spring so as to oscillate in the casting direction; and oscillation drive means connected to the support frame for oscillating the continuous casting mold, the oscillation drive means including a servo-hydraulic cylinder fixed to the support frame in a longitudinal sectional plane which passes through the continuous casting mold laterally adjacent the continuous casting mold so that the cylinder is free of play, the continuous casting mold being fastened to the springs at one location.

2. A device according to claim 1, wherein the continuous casting mold is an arc-type mold having a curved longitudinal axis, the springs being arranged in a region of a top edge and a bottom edge of the continuous casting mold and aligned in a lengthwise direction on a straight line which passes through a center of curvature of the longitudinal axis of the mold, parallel to the longitudinal sectional plane of the mold.

3. A device according to claim 1, wherein the mold has a curved longitudinal axis, the one location at which the continuous casting mold is fastened to the springs is displaced from a center point between frame-side intersection points of the springs towards a center of curvature of the curved longitudinal axis, the servo-hydraulic cylinder having a piston rod that is fastened to a lower edge of the mold in a stroke direction of the piston rod.

4. A device according to claim 3, wherein the piston rod has an upper end that is fastened to the springs, the upper end of the piston rod being configured as a spring element.

5. A device according to claim 4, wherein the continuous casting mold has wide-side plates and narrow-side plates clamped between the wide-side plates, and further comprising fastening blocks to which the narrow-side plates are fastened, and still further comprising a bracket connected to the support frame, the servo-hydraulic cylinder being fastened to the bracket, the spring element of the piston rod being fastened on a bottom side of one of the fastening blocks to which the narrow-side plates is fastened.

6. A device according to claim 5, and further comprising means for clamping the springs to top and bottom sides of the fastening blocks, clamping blocks mounted on the support frame, the ends of the springs being held in the clamping blocks, and fastening supports arranged on the support frame, the clamping blocks being mounted to the fastening supports.

* * * * *